United States Patent [19]

Akagi

[11] Patent Number: 4,561,590

[45] Date of Patent: Dec. 31, 1985

[54] FUEL INJECTION NOZZLE ASSEMBLY

[75] Inventor: Jiro Akagi, Oyama, Japan

[73] Assignee: Kabushiki Kaisha Komatsu Seisakusho, Tokyo, Japan

[21] Appl. No.: 453,995

[22] Filed: Dec. 28, 1982

[30] Foreign Application Priority Data

Dec. 28, 1981 [JP] Japan ..... 56-209922

[51] Int. Cl.[4] ..... F02M 41/16

[52] U.S. Cl. ..... 239/96; 239/533.7; 239/533.9

[58] Field of Search ..... 239/96, 533.3–533.12

[56] References Cited

U.S. PATENT DOCUMENTS

| | | | |
|---|---|---|---|
| 2,959,360 | 11/1960 | Nichols | 239/96 |
| 2,985,378 | 5/1961 | Falberg | 239/96 |
| 3,442,451 | 5/1969 | De Nagel | 239/96 |
| 3,610,529 | 10/1971 | Huber | 239/96 |
| 3,982,694 | 9/1976 | Bailey | 239/533.5 |
| 4,200,231 | 4/1980 | Knape | 239/96 |

FOREIGN PATENT DOCUMENTS

| | | | |
|---|---|---|---|
| 2065772 | 7/1981 | United Kingdom | 239/533.8 |

*Primary Examiner*—Andres Kashnikow
*Assistant Examiner*—Michael J. Forman
*Attorney, Agent, or Firm*—Armstrong, Nikaido, Marmelstein & Kubovcik

[57] ABSTRACT

A fuel injection nozzle assembly for the injection of fuel under pressure into a combustion chamber of an internal combustion engine. A nozzle body has formed therein a fuel inlet, a storage chamber and spray orifices for discharging pressurized fuel from the storage chamber. Disposed in the storage chamber is a needle valve for opening and closing the spray orifices and a check valve for admitting a metered amount of pressurized fuel into the storage chamber. The needle valve has formed therein a blind hole in which is slidably mounted a stem extending from a cylindrical section of a check valve and an axial passageway is formed through the stem.

3 Claims, 2 Drawing Figures

FUEL INJECTION NOZZLE ASSEMBLY

BACKGROUND OF THE INVENTION

This invention relates to a fuel injection nozzle assembly with improved response for internal combustion engines.

The fuel injection nozzle assembly of pressure accumulation type which has so far been installed on engines comprises a needle valve located in the nozzle body and biased downwardly by the force of a compression spring, the tip of the needle valve being adapted to close spray orifices. Further, the needle valve has mounted thereon at its upper end a check valve adapted to close a fuel supply port. The arrangement is made such that when fuel under high pressure is supplied into this fuel supply port the check valve will open to allow the fuel under high pressure to flow into the nozzle body, and further when the pressure of the fuel within the nozzle body overcomes the force of the compression spring biasing the needle valve downwardly the needle valve will move upwards thereby opening the spray orifices and enabling the fuel to be injected through the latter into the cylinder. However, the fuel injection nozzle assembly of such a construction has been disadvantageous in that, because the needle valve supports the check valve, the mass of the needle valve is large, and therefore the response of it is poor because of its large inertia at the time of opening and closing the spray orifices, and also the durability of it is low because of its long overall length.

SUMMARY OF THE INVENTION

It is therefore an object of the present invention to provide a fuel injection nozzle assembly having improved response characteristics.

Another object of the present invention is to provide a fuel injection nozzle assembly which is simple in construction yet significantly improves durability thereof.

In accordance with an aspect of the present invention, there is provided a fuel injection nozzle assembly for the injection of fuel under pressure into a combustion chamber of an internal combustion engine, comprising: a body having formed therein a fuel inlet for admitting pressurized fuel, a storage chamber for receiving the incoming pressurized fuel and a spray orifice for discharging in the form of droplets the pressurized fuel from the storage chamber; a spring in the storage chamber; a needle valve within said body for covering and uncovering the spray orifice, said needle valve having formed therein a blind hole opening to the storage chamber and being normally held in a position to cover the spray orifice under the bias of said spring and adapted to be acted upon by the pressurized fuel in the storage chamber for uncovering the spray orifice against the bias of said spring; and a check valve in the storage chamber, said check valve being normally held under the bias of said spring against a wall of said body to bound an inlet chamber in constant communication with the fuel inlet and yielding against the bias of said spring to allow introduction of the pressurized fuel from the fuel inlet into the storage chamber via the inlet chamber, said check valve including a large diameter cylindrical section and a stem extending from the cylindrical section which is slidably mounted in the blind hole of said needle valve and having formed therein an axial passageway through the cylindrical section and the stem.

The above and other objects, features and advantages of the present invention will be readily apparent from the following description taken in conjunction with the accompanying drawings.

DESCRIPTION OF THE PREFERRED EMBODIMENT

Figure 1:
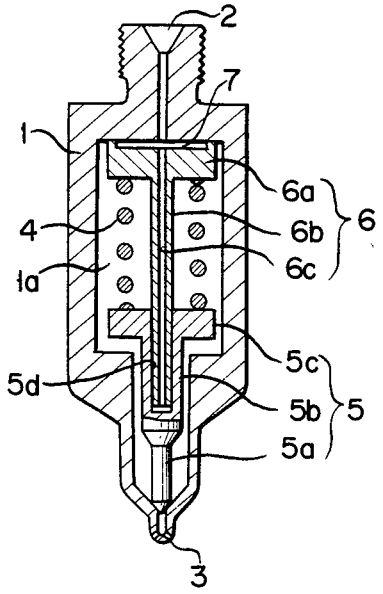
FIG. 1 is a longitudinal sectional view of a fuel injection nozzle assembly according to the present invention.

The present invention will now be described in detail below by way of example only with reference to the accompanying drawings. In the drawing, reference numeral 1 denotes a nozzle body installed on each cylinder of an internal combustion engine not shown. The nozzle body 1 has a fuel inlet port 2 formed in the upper part thereof, spray orifices 3 formed in the tip of the lower part thereof, and a needle valve 5 located within the nozzle body 1 and biased downwardly by the force of a compression spring 4. Although in the drawings, the nozzle body 1 is shown as a single body, this actually comprises several parts threaded together to permit assembly. For the purpose of this invention, however, the nozzle body can be considered as a single unit.

The needle valve 5 comprises a small diameter portion 5*a* and a large diameter portion 5*b*, the leading end of the small diameter portion 5*a* being adapted to close and open spray orifices 3, whilst the large diameter portion 5*b* having a spring retainer 5*c* formed in the uppermost part thereof and against which one end of the compression spring 4 abuts.

Figure 2:
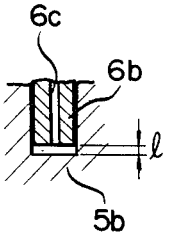
FIG. 2 is an enlarged fragmentary sectional view of the leading end of a stem of a check valve.

Further, the large diameter portion 5*b* has formed therein a blind hole 5*d* whose one end opens in the central part of the upper surface of the spring retainer 5*c*. Slidably inserted in the blind hole 5*d* is the leading end portion of a valve stem 5*b* projecting downwardly from a cylindrical section 6*a* of a check valve 6. The cylindrical section 6*a* is biased upwardly by the force of the compression spring 4 so as to close the fuel inlet port 2 and to define a fuel inlet chamber 7 and the valve stem 6*b* has a passage 6*c* formed therein and extending through both ends of the check valve 6. The arrangement is made such that when the cylindrical section 6*a* of the check valve 6 closes the fuel inlet port 2 and the leading end of the needle valve 5 closes the spray orifices 3, a clearance l corresponding to the up and down stroke of the needle valve 5 is formed between the valve stem 6*b* and the bottom of the blind hole 5*d* as shown in FIG. 2.

Thus, if and when fuel under a high pressure is delivered by a fuel injection pump not shown into the fuel inlet port 2, then the valve stem 6*b* of the check valve 6 is depressed to allow the fuel under high pressure to flow into the fuel storage chamber 1*a*. At that time, the needle valve 5 is urged downwards by the tip of the valve stem 6*b* and the spring 4 thereby still keeping the spray orifices 3 closed.

Upon completion of the fuel supply, the cylindrical section 6*a* of the check valve 6 will move upwards to close the fuel inlet port 2, and at the same time, the needle valve 5 will be raised by the pressure of the fuel within the fuel storage chamber 1*a* against the force of the compression spring 4 so that the fuel within the chamber 1*a* can be injected through the spray orifices 3 into the cylinder. Upon termination of the fuel injection, the pressure within the fuel storage chamber 1*a* will drop, and consequently, the needle valve 5 will move down to thereby close the spray orifices 3.

As described in detail hereinbefore, according to the present invention, the mass of the needle valve can be reduced by half as compared with that of the conventional one so that the inertia of the needle valve when opening and closing spray orifices can be reduced correspondingly thereby improving the response thereof remarkably. Further, because of the shortening of the length of the needle valve itself, there is no possibility of deformation of it due to the pressure exerted thereon so that the durability thereof can be improved considerably, and also because of the construction of the needle valve independently from the support part of the check valve the fuel injection nozzle assembly can be manufactured easily.

It is to be understood that the foregoing description is merely illustrative of a preferred embodiment of the invention, and that the invention is not to be limited thereto, but is to be determined by the scope of the appended claims.

What is claimed is:

1. A fuel injection nozzle assembly for the injection of fuel under pressure from a fuel injection pump into a combustion chamber of an internal combustion engine, comprising:

a nozzle body having formed therein a storage chamber for receiving incoming pressurized fuel and a spray orifice for discharging in the form of droplets said pressurized fuel from said storage chamber;

a needle valve within said storage chamber for closing and opening said spray orifice, said needle valve having a small diameter portion positioned at said spray orifice and adapted to close and open said spray orifice, a central large diameter portion and a spring retainer portion, and having a blind hole formed in said spring retainer portion and said large diameter portion and opening to said storage chamber;

a check valve including a large diameter cylindrical section formed with a recess at one end to define a fuel inlet chamber, a stem portion extending from the other end of said cylindrical section, and an axial passage extending through said cylindrical section and said stem portion, said check valve being positioned in said storage chamber with said stem portion slidably mounted in said blind hole of said needle valve, whereby said axial passage connects said fuel inlet chamber with the interior of said blind hole;

a spring positioned in said storage chamber between said spring retainer portion of said needle valve and said cylindrical section of said check valve and adapted to bias said needle valve to close said spray orifice and to bias said check valve recessed cylindrical portion against a wall of said body to form said fuel inlet chamber; and a fuel inlet port in said wall of said body in communication with said fuel inlet chamber and adapted to be connected to said fuel injection pump to allow introduction of pressurized fuel into said storage chamber via said inlet chamber and said check valve against the bias of said spring.

2. A fuel injection nozzle assembly as recited in claim 1 wherein clearance between the bottom of said blind hole and said stem portion when said needle valve is seated and said check valve is held against said wall of said body is equal to the up and down stroke distance of said needle valve.

3. A fuel injection nozzle assembly as recited in either claim 2 or claim 1 wherein said needle valve is urged by said check valve stem portion to close said spray orifice when said check valve is open during introduction of pressurized fuel from said fuel injection pump, and said needle valve is raised against the force of said spring by pressure of said fuel within said fuel storage chamber when said check valve is closed upon completion of introduction of said pressurized fuel.

* * * * *